United States Patent [19]

Bowers

[11] Patent Number: 4,986,351

[45] Date of Patent: Jan. 22, 1991

[54] PORTABLE PUMP REMOVAL EQUIPMENT

[75] Inventor: Kenneth E. Bowers, Jefferson, Md.

[73] Assignee: Marshall E. Wisner, Jefferson, Md.

[21] Appl. No.: 446,111

[22] Filed: Dec. 5, 1989

[51] Int. Cl.[5] ..... E21B 19/22

[52] U.S. Cl. ..... 166/85; 166/77; 166/384; 254/30

[58] Field of Search ..... 166/77, 85, 384, 385, 166/96, 75.1, 68, 72, 73; 254/30; 226/168, 189, 190

[56] References Cited

U.S. PATENT DOCUMENTS

| | | | |
|---|---|---|---|
| 1,011,614 | 2/1911 | Green et al. | 254/30 |
| 2,843,358 | 7/1958 | Anderson | 254/30 |
| 3,116,781 | 1/1964 | Rugeley et al. | 166/77 |
| 3,871,618 | 3/1975 | Funk | 254/30 |
| 3,920,076 | 11/1975 | Laky | 166/77 X |
| 4,188,997 | 2/1980 | Ainsworth | 166/77 |
| 4,570,705 | 2/1986 | Walling | 166/77 |

*Primary Examiner*—Stephen J. Novosad
*Attorney, Agent, or Firm*—Larson & Taylor

[57] ABSTRACT

A portable pump removal equipment is provided which includes a collar to be secured to the upper end of a well casing, a pair of arms extending outwardly and upwardly from the collar with a wheel rotatably mounted on the outer ends of the pair of arms. A V-shaped guideway is mounted around the periphery of the wheel which releasably engages pipe pulled from the well casing. A latching mechanism on the wheel permits rotation of the wheel in a direction to withdraw the pipe and the pump from the well casing. Rollers mounted on horizontally extending axes on the upper surface of the collar permit the pipe to be withdrawn from the casing without engaging the casing wall.

4 Claims, 2 Drawing Sheets

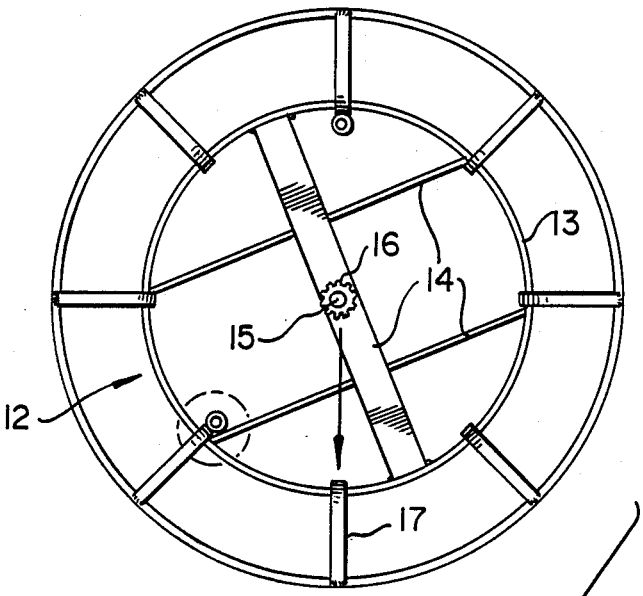
FIG. 4
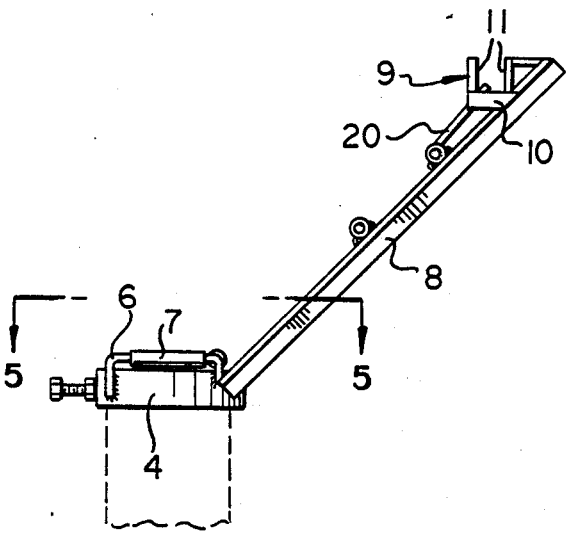
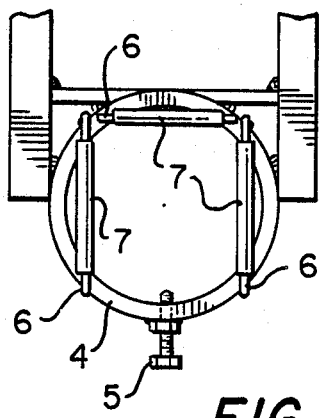
FIG. 5
FIG. 6
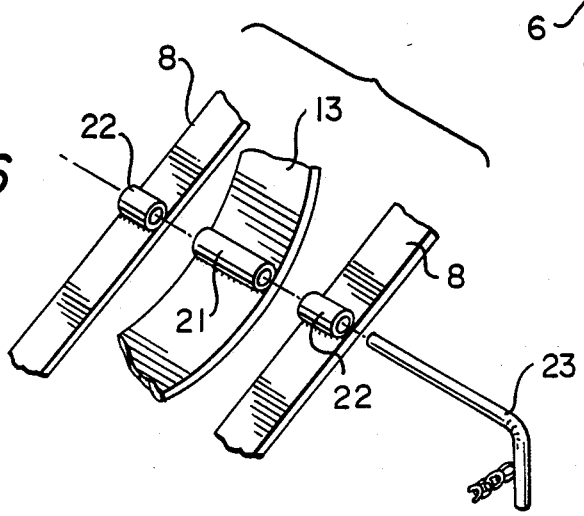

PORTABLE PUMP REMOVAL EQUIPMENT

The present invention relates to a portable apparatus for removing pipe and a pump from a well casing.

BACKGROUND OF THE INVENTION

There have been a number of prior art devices which provide a means for withdrawing pipe and a pump from a well casing. Examples of such devices are the patents to Dawes 2,820,607 Rainwater 2,297,164, Lyons 4,585,061 and Green et al 1,011,614. These devices provide cranes, motors and other expensive heavy equipment to perform the function of pulling pipe from a well casing. However, not one of these devices is readily portable so that it can be placed in operation by one person without the use of heavy machinery, motors and the like. There is in the prior art a portable well pipe puller shown in patent 3,871,618 to Funk. However, even this patent requires an electric motor for driving the wheels which engage the pipe to be withdrawn from the casing.

According to the present invention there is provided a pump puller which can be readily installed for operation by one person and does not require motors or the like to withdraw the pipe and pump from the casing. A collar is provided with clamping means so that the collar can be clamped on the outer surface of the well casing and a pair of arms are attached to the collar which extend outwardly and upwardly from the collar. A large diameter wheel is mounted on the upper end of the arms and the periphery of the wheel provides a generally V-shaped guideway so that when the pipe is passed around the wheel the wheel will releasably engage the pipe within the V-shaped guideway. A latching mechanism is provided on the wheel so that the pipe may be pulled as the wheel is rotated but upon release of the pipe by the person pulling the pipe from the well the engagement of the pipe with the wheel and the latching mechanism prevents the pipe from returning to the well casing. A plurality of rollers is provided on the upper surface of the collar with the rollers being disposed on horizontal axes and in a generally U-shaped configuration. This structure prevents the pipe from coming into engagement with the well casing as the pipe is being withdrawn from the well.

An object of the present invention is to provide a pump puller which is portable and which may be readily installed and the pipe and pump removed from the well by a single operator.

Another object of the present is to provide a pump puller having a collar which engages the well casing and which is provided with pair of arms which extend upwardly and outwardly having a wheel mounted on the upper ends of the arms and means on the wheel for releasably retaining pipe pulled from the well casing.

Other objects and many attendant advantages of the present invention will become more readily apparent upon consideration of the following detailed specification in connection with the accompanying drawings wherein:

DETAILED DESCRIPTION OF THE DRAWINGS

Figure 1:
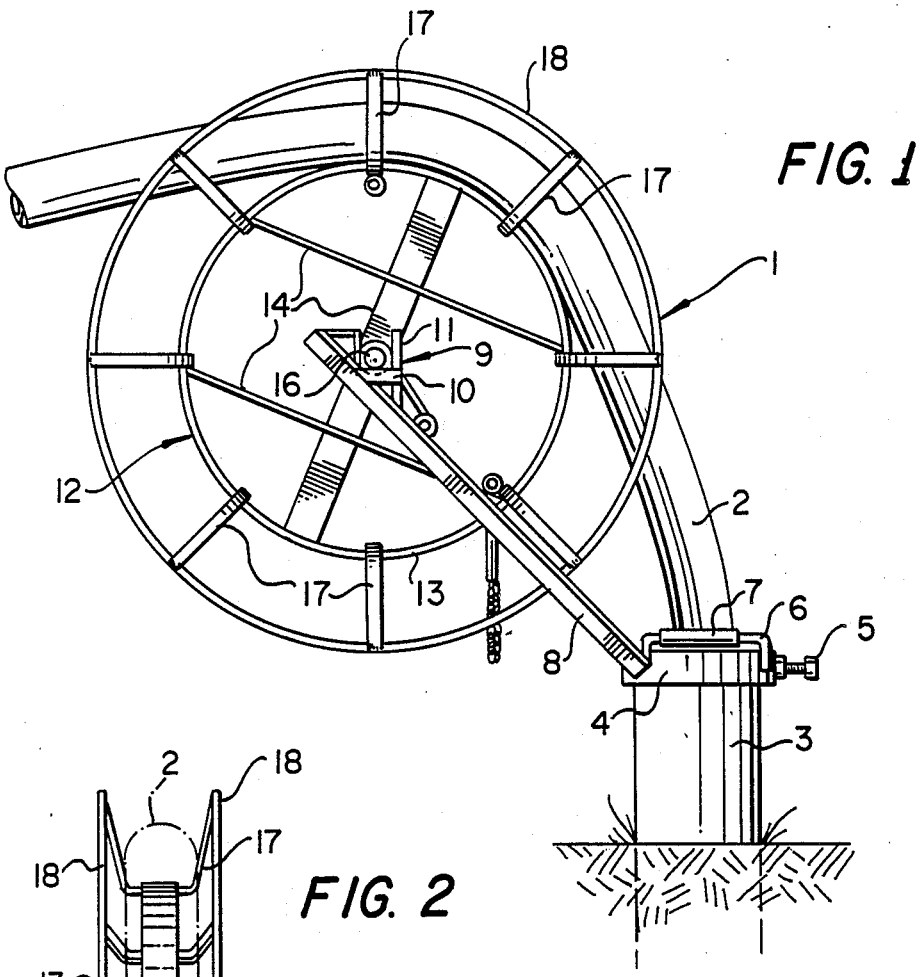
Figure 2:
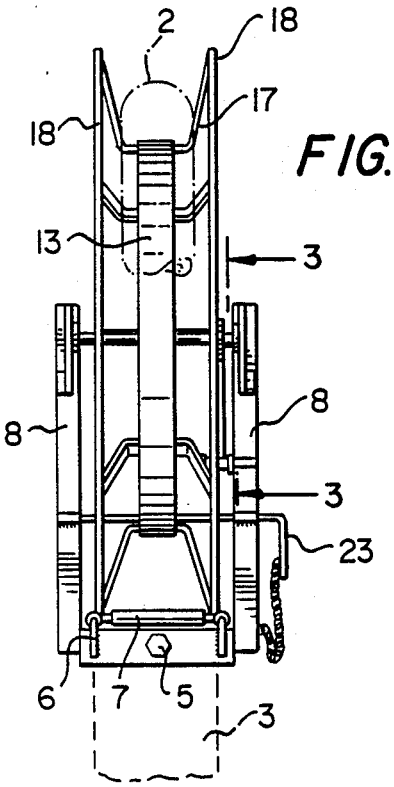
Figure 3:
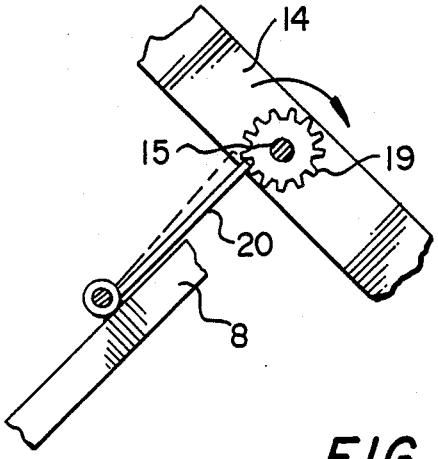

FIG. 1 is a side elevation of the pump removal equipment attached to a well casing, FIG. 2 is an end elevation from the left side of FIG. 1, FIG. 3 a partial sectional view along the line 3—3 of FIG. 2, FIG. 4 an exploded side elevation showing the wheel removed frame, FIG. 5 is a plan view of the clamping means along the line 5—5 of FIG. 4 showing the retaining collar, and FIG. 6 is a partial perspective view of the wheel locking means.

DETAILED DESCRIPTION OF THE PREFERRED EMBODIMENT

The pump removal equipment shown generally at 1 is specifically designed to remove well pipe 2 and a pump connected to the remote end of the pipe 2 from a well casing 3.

The pump removal equipment includes a circular collar 4 which is adapted to fit around the external periphery of the well casing 3. There is provided a bolt 5 or a plurality of bolts may be provided to ensure that the collar 4 is retained tightly on the external surface of the well casing 3. Welded to the collar 4 and extending across and in spaced relation to the upper surface of collar 4 are U-shaped brackets 6 as seen in FIGS. 1, 2 and 5. Each of the brackets 6 have an elongated roller 7 thereon, the rollers serving the function of preventing the pipe 2 from coming into contact with the side of the well casing 3 or collar 4 as the piping 2 is being withdrawn from the well.

Welded to the outer face of the collar 4 are a pair of angle arms 8 which extend upwardly and outwardly from the collar 4. At the upper end of each arm 8 there is provided a shaft retaining frame 9 as seen in FIGS. 1 and 4. The frame 9 includes a pair of bottom plates 10 which are welded to the angle arms 8. Each plate has a recess in the upper surface thereof and is provided with upstanding arms 11 on each end of bottom plate 10.

There is provided a large wheel shown generally at 12 which has a rim 13 and internal supporting frame members 14. Extending between a pair of frame members 14 located on each side of rim 13 is a shaft 15 with roller bearings 16 on each end thereof. As shown in FIGS. 1 and 4 the wheel 12 may be removably retained within the shaft retaining frame 9. The lower end portion of the roller bearings 16 fit within the recess within the bottom plates 10 and the upstanding arms 11 engage the outer faces of the roller bearings. The wheel 12 may be lifted out of the shaft retaining frame 9 when the pump removal equipment is disassembled.

The rim 13 of the wheel has welded thereto a plurality of generally V-shaped brackets 17 which as seen in FIG. 2 has arms sloping outwardly with the outer ends of the arms welded to rings 18. As can be seen in FIG. 2, the well pipe 2 engages the sloping inside faces of the V-shaped brackets 17 so that the piping is held by the brackets on the wheel assembly 12 as it is being pulled from the well casing 3.

As shown in FIG. 3, the frame member 14 has secured on the inner face thereof a ratchet 19 which is fixed to the inner face 14 and secured on shaft 15 so that the ratchet rotates with the shaft 15. A locking arm 20 is pivotally mounted on the angle arm 8 so that the wheel 12 may be rotated in the direction of the arrow shown in FIG. 3 but will lock the wheel to prevent rotation in a counterclockwise direction. Thus, as the wheel 12 is rotated to withdraw the pipe 2 and pump from the well by an operator grasping the rings 18, the pipe will be retained by engagement with the V-shaped brackets 17 and will be prevented from moving back into the well casing by engagement of the locking arm 20 with the ratchet 19.

As shown in FIG. 6, the wheel rim 13 has a tube 21 welded on the inner surface thereof and the angle arms 8 have similar tubes 22 welded on the upper faces thereof. When it is desired to lock the wheel in a fixed position to prevent rotation of the wheel in either direction, the tubular members 21 and 22 are brought into alignment and the locking bar 23 is inserted through the tubular members 21 and 22 so as to prevent rotation of the wheel 12 with respect to the angle arms 8.

In use when it is desired to move pipe 2 and a pump from a well, the disassembled portable pump removal equipment is brought to the well site. The collar 4 is placed around the upper end of the well casing 3 and the bolt 5 is tightened so as to retain the collar firmly on the well casing. The wheel 12 may then be placed on the outer end of the angle arms 8. The roller bearings 16 are engaged within the shaft retaining frame 9 so that the wheel 12 may be rotated within this frame. The well pipe 2 is then placed on the rim 13 of wheel 12 around the upper surface thereof so as to be retained thereon by the V-shaped brackets 17 as seen in FIGS. 1 and 2. The operator may then grasp the rings 18 and bracket arms 17 and turn the wheel so as to withdraw the pipe from the well. This pulling of the pipe from the well may be achieved with short separate pulling strokes since the latching mechanism shown in FIG. 3 prevents counterclockwise movement of the wheel 12 and thus does not permit the pipe to return to the well casing. The rollers 7 on the collar 4 prevent the pipe from coming in contact with the well casing 3 or the edges of the collar 4.

Obviously many modifications and variations of the present are possible in light of the above teachings.

What is claimed as new and is desired to be secured by Letters Patent is:

1. A pump removal equipment for pulling pipe and a well pump from a well casing comprising a collar fitting around the outer surface of the well casing, means for securing the collar on the well casing, a plurality of rollers mounted on the upper surface of the collar, a pair of arms fixed on opposite sides of said collar and extending angularly and upwardly away from the well casing, a wheel rotatably mounted on the outer ends of said pair of arms, a V-shaped guideway mounted on the periphery of said wheel for releasably gripping pipe pulled from the well casing, and latching means for permitting rotation of the wheel only in one direction to withdraw pipe from the well.

2. A pump removal equipment according to claim 1 wherein said plurality of rollers are disposed on horizontal axes in a generally U-shaped configuration.

3. A pump removal equipment for pulling pipe and a pump from a well casing comprising clamping means for engagement with the well casing, a supporting frame fixedly mounted on said clamping means and extending outwardly from said clamping means, a wheel rotatably mounted on one end of said supporting frame, means on said wheel for releasably gripping the well pipe as the pipe is withdrawn from the well, and a plurality of rollers mounted on said clamping means for engagement with the well pipe.

4. A pump removal equipment for pulling pipe and a pump from a well casing comprising clamping means for engagement with the well casing, a supporting frame fixedly mounted on said clamping means and extending outwardly from said clamping means, a wheel rotatably mounted on one end of said supporting frame, means on said wheel for releasably gripping the well pipe as the pipe is withdrawn from the well, and latching means for permitting rotation of said wheel only in one direction to withdraw pipe from the well.

* * * * *